United States Patent [19]

Vetter

[11] Patent Number: 4,773,830

[45] Date of Patent: Sep. 27, 1988

[54] CONTROL APPARATUS FOR A GAS DRIVEN PUMP

[75] Inventor: Matthew R. Vetter, Oakpark, Ill.

[73] Assignee: Addison Pump Company, Addison, Ill.

[21] Appl. No.: 24,246

[22] Filed: Mar. 10, 1987

[51] Int. Cl.[4] ..... F04F 1/06

[52] U.S. Cl. ..... 417/38; 251/75; 417/39; 417/138

[58] Field of Search ..... 417/137, 138, 38, 39; 251/75

[56] References Cited

U.S. PATENT DOCUMENTS

| | | | |
|---|---|---|---|
| 1,191,469 | 7/1916 | Rixen | 417/38 |
| 2,551,445 | 5/1951 | Lindsey et al. | 251/76 X |
| 2,671,632 | 3/1954 | Palmer | 251/75 X |
| 2,689,585 | 9/1954 | Presnell | 251/76 X |
| 3,422,768 | 1/1969 | Repp | 417/138 |
| 3,922,111 | 11/1975 | Deters | 417/38 X |
| 4,021,147 | 5/1977 | Brekke | 417/138 |
| 4,207,030 | 6/1980 | Pearson | 417/38 |
| 4,645,426 | 2/1987 | Hartley et al. | 417/38 |

FOREIGN PATENT DOCUMENTS

| | | | |
|---|---|---|---|
| 1006762 | 3/1977 | Canada | 417/138 |

*Primary Examiner*—Carlton R. Croyle

*Assistant Examiner*—Theodore Olds

*Attorney, Agent, or Firm*—John C. Albrecht

[57] ABSTRACT

A gas driven pump (102) is controlled by an asynchronous controller (101). The controller (101) has two control conduits (105,103) respectively in communication with the bottom and top regions of the chamber of the pump (102). Low pressure air is bubbled through the control conduit (105) in communication with the bottom region of the pump chamber; therefore, the pressure in that conduit, which is applied to the face top of the diaphragm (111), in a direct function of the depth of the liquid in the pump chamber. The other control conduit (103) is in communication with the bottom face of the diaphragm (111). When the difference of the pressures in the control conduits (105,103) exceeds the bias of the spring (114), the diaphragm (111) and the attached spool (128) move downward to activate a mechanically operated pilot valve (144). The pilot valve, in turn, releases supply air under pressure to switch the main valve (145) from the rest state to the operated state to initiate discharge of liquid by the pump. When the level of the liquid in the pump chamber falls to a point where the difference in the pressures in the control conduits reaches a second threshold value, the diaphragm moves upward to the rest state; the pilot valve and the main valve are deactivated; and the pump,enters the fill state.

9 Claims, 3 Drawing Sheets

CONTROL APPARATUS FOR A GAS DRIVEN PUMP

TECHNICAL FIELD

This invention relates to gas driven pump systems which adapt the pumping rate to the rate of liquid flow into the pump environment.

BACKGROUND ART

Gas driven pumps are used in a variety of applications. In some applications, the pumping capacity is less than the rate at which liquid flows into the pump environment; and in other applications the pumping capacity is greater than the rate of liquid inflow. In the former case, pumping rates are established in accordance with considerations other than the level of liquid in the pump environment. For example, in some applications an ejector pump is cycled through fill and discharge periods purely on the basis of time.

Where the pumping capacity exceeds the rate of liquid inflow, a number of mechanical and/or electrical devices e.g., floats, probes and switches have been employed to detect liquid levels to initiate and terminate pumping. Some mechanical and electrical devices are a liability in a liquid pumping environment; and they are particularly troublesome in an environment of dirty and/or chemically active or combustible liquids.

STATEMENT OF THE INVENTION

In accordance with the present invention a gas driven pump which comprises: a pump chamber; liquid inflow and liquid outflow ports connected to the bottom of the pump chamber: and a vent/pressurizing port further comprises: pump control means for sensing differences in pressures at the top and the bottom of the pump chamber; and means for initiating pumping when the difference reaches a first threshold value and for stopping pumping when the difference subsequently reaches a second threshold value. Advantageously, the control apparatus in accordance with this invention accomplishes pump control without the introduction of any mechanical and/or electrical devices into the pumped liquid. The use of differential pressure as the control input results in little stress on the control elements; and allows a very sensitive determination of the depth of liquid in the pump chamber.

Additionally, since the control is entirely pneumatic, the pump and its controls are intrinsically safe.

THE DRAWING

The invention is illustrated more or less diagrammatically in the drawing wherein.

DETAILED DESCRIPTION

Figure 1:
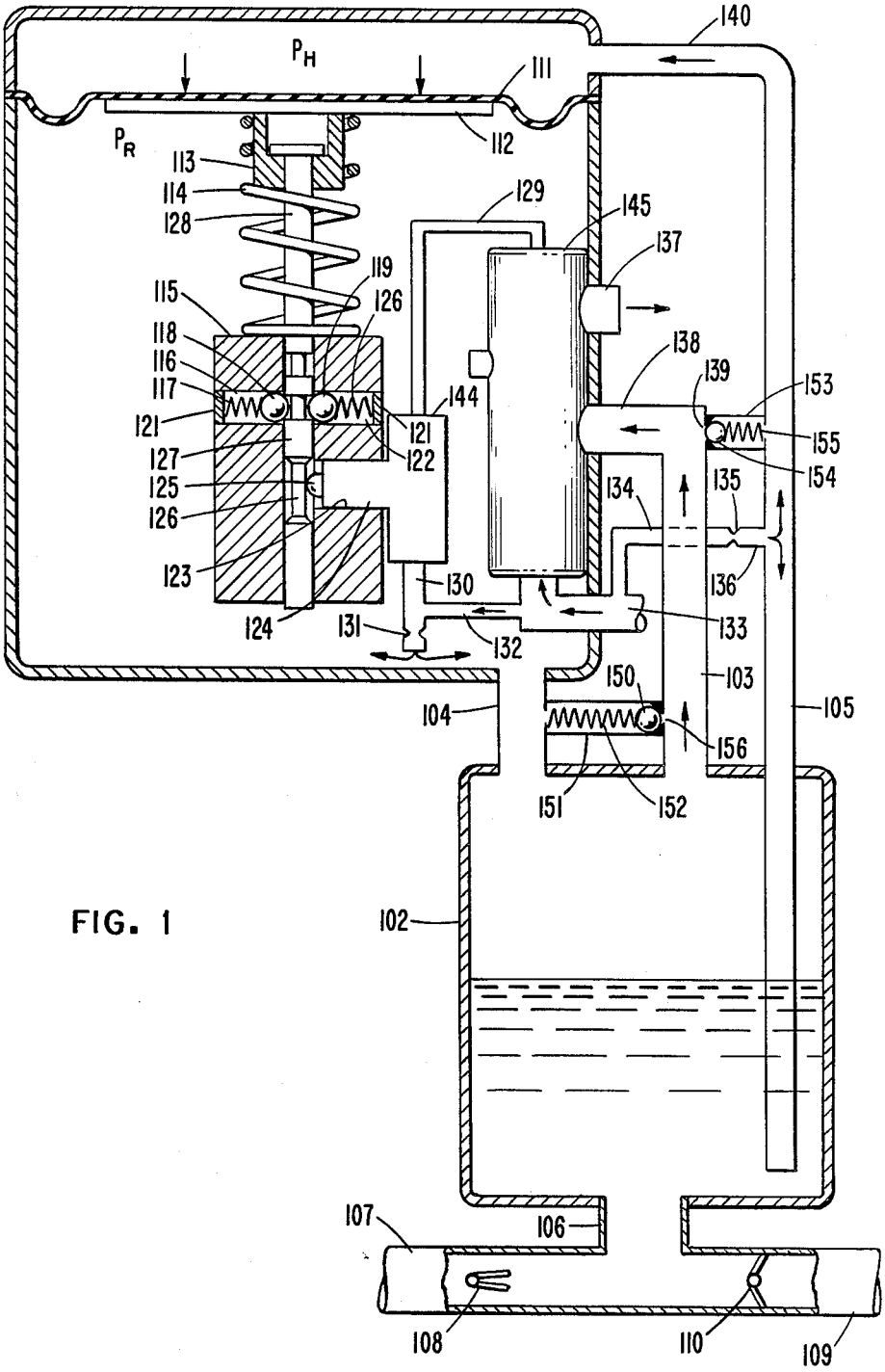
FIG. 1 illustrates one embodiment of a pump system in accordance with my invention in the fill state.

The pump system of FIG. 1 comprises the pump 102, the pump controller 101 and the interconnecting conduits 103, 104 and 105. The various valves of the system of FIG. 1 and the lines which indicate direction of flow are illustrated for the "fill" state of the pump. The pump controller 101 may be mounted directly on top of the pump or may be located at a point remote from the pump. When the controller 102 is mounted on top of the pump 102, the conduit 104 is merely a hole in the top of the pump 101 and a connecting hole in the bottom of the controller 102.

The pump 102 has an inflow port 107 with a valve 108 which permits liquid to flow into the pump chamber and prevents outward flow of liquid through the port 107. The outflow port 109 includes the valve 110 which prevents the flow of liquid into the chamber through that port. The valves 108 and 110 may be check valves as illustrated in the drawing or they may be pneumatic or otherwise operated valves which are not illustrated in the drawing.

In FIG. 1, liquid flows in and out of the pump chamber through the common opening 106. While this is a convenient structure, the liquid inflow and outflow can be via separate openings in the pump walls. In any event, the bottom end of the control conduit 105 is advantageously placed opposite the bottom wall of the pump chamber and not opposite an opening therein.

The control conduits 104 and 105 respectively couple the upper region of the pump chamber to the lower face of the diaphragm 111 and its backing plate 112; and the lower region of the pump chamber to the upper face of the diaphragm 111. Accordingly, the position of the diaphragm is influenced by the difference in the pressures which are present in the upper and lower regions of the pump chamber and by the force of the bias spring 114. Additionally, the spring loaded detent balls 118, 119, which engage the detent recesses in the spool 128, tend to keep the spool 128 and the attached diaphragm in the current state.

In the "fill" state, the liquid which flows in through the port 107 displaces air in the chamber and that air is vented through the opening 137 in the main air valve 145. As seen in FIG. 1, fresh air or gas from the air supply conduit 133 is supplied to the controller housing at essentially zero pressure through the choke 131. Accordingly, the pressure on the lower face of the diaphragm 111 and its backing plate 112 is the pressure in the upper region of the pump chamber. If the liquid in the pump chamber is above the lower end of the control conduit 105, the pressure in the upper region of the pump chamber also acts on the top surface of that liquid.

Additionally, in the "fill" state, air through the choke 135 is fed to and bubbled through the liquid via the control conduit 105. Accordingly, the pressure of the air in the control conduit 105, and thus acting on the top face of the diaphragm 111, is determined by the height of the liquid in the chamber and the pressure in the top of the chamber. Since the pressure in the top of the chamber acts on both faces of the diaphragm 111, the net force on the diaphragm is that which is due to the height of the water.

When the difference in pressure on the two faces of the diaphragm exceeds the restraining force of the detents 118 and 119 and the force of the bias spring 114, the diaphragm and the attached spool 128 will "snap" down to the operated state of the diaphragm. As illustrated in FIG. 1, the diaphragm is at the "rest" state. The function of the pump control when the diaphragm 111 is in the "operated " state is best understood from a description of FIG. 2 which illustrates the discharge of liquid from the pump.

Figure 2:
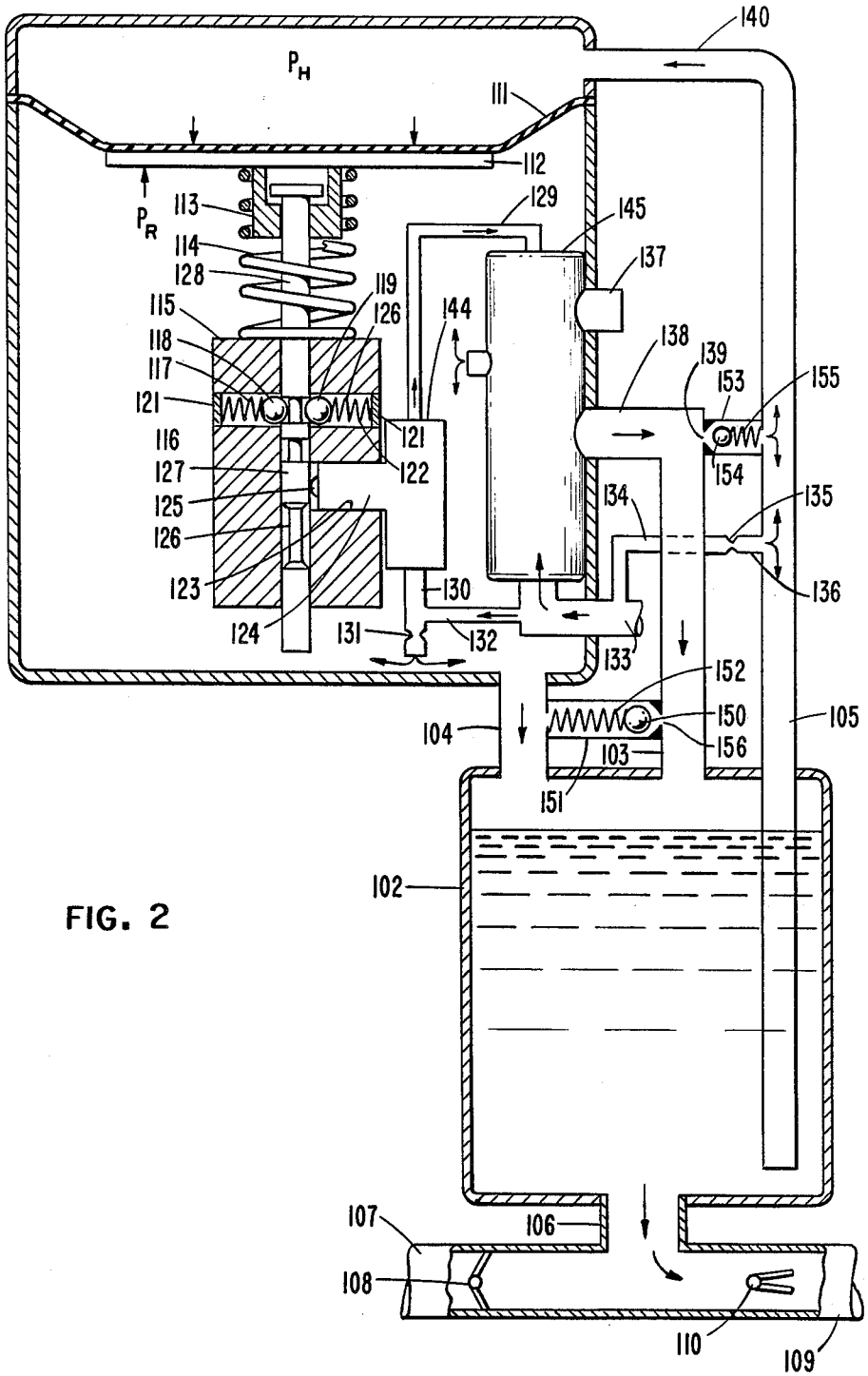
FIG. 2 illustrates the pump system of FIG. 1 in the discharge state.

In FIG. 2, the diaphragm 111, the backing plate 112 and the rod 128 are illustrated in the "operated state" of the diaphragm. In that state, the camming surface 127 of the rod 128 forces the ball 125 into the body of the pilot valve 144 to provide an air path between the pilot valve output conduit 129 and the conduit 130, which is connected to a source of relatively high pressure air or gas which is supplied via conduit 133. When this air source is applied to the control port of the main valve 145, the main valve will change from the "fill" state to the "discharge" state.

In the discharge state, the main valve 145 provides an air path between the source conduit 133 and the conduit 138. As the pressure in the upper region of the pump chamber 102 consequently rises, the valve 108 will close and the valve 110 will open. Accordingly the liquid in the pump chamber 102 will be ejected through the output port 109 which conveys the liquid to a planned destination. As the liquid is ejected from the pump chamber 102, the difference in pressure between the upper and lower regions of the pump chamber falls. When the difference reaches a second threshold value, the force of the compressed spring 114 will overcome the restraining force of the detents 118 and 119 in the upper annular recess in the rod 128, and the diaphragm 111 will snap back to the rest state to again initiate the fill state of the pump.

While the pump is in the discharge state, high pressure fresh air from conduit 138 is transmitted to the upper and lower portions of the control chamber by the conduits 151 and 153. The introduction of fresh air into the control chamber prevents the flow of possibly harmful gases into the control chamber from the pump chamber. The gases which may occur in the pump chamber could be harmful to the control apparatus. In the fill state, the spring loaded check valves 154 and 150 isolate the control chamber from the conduit 138.

Figure 3:
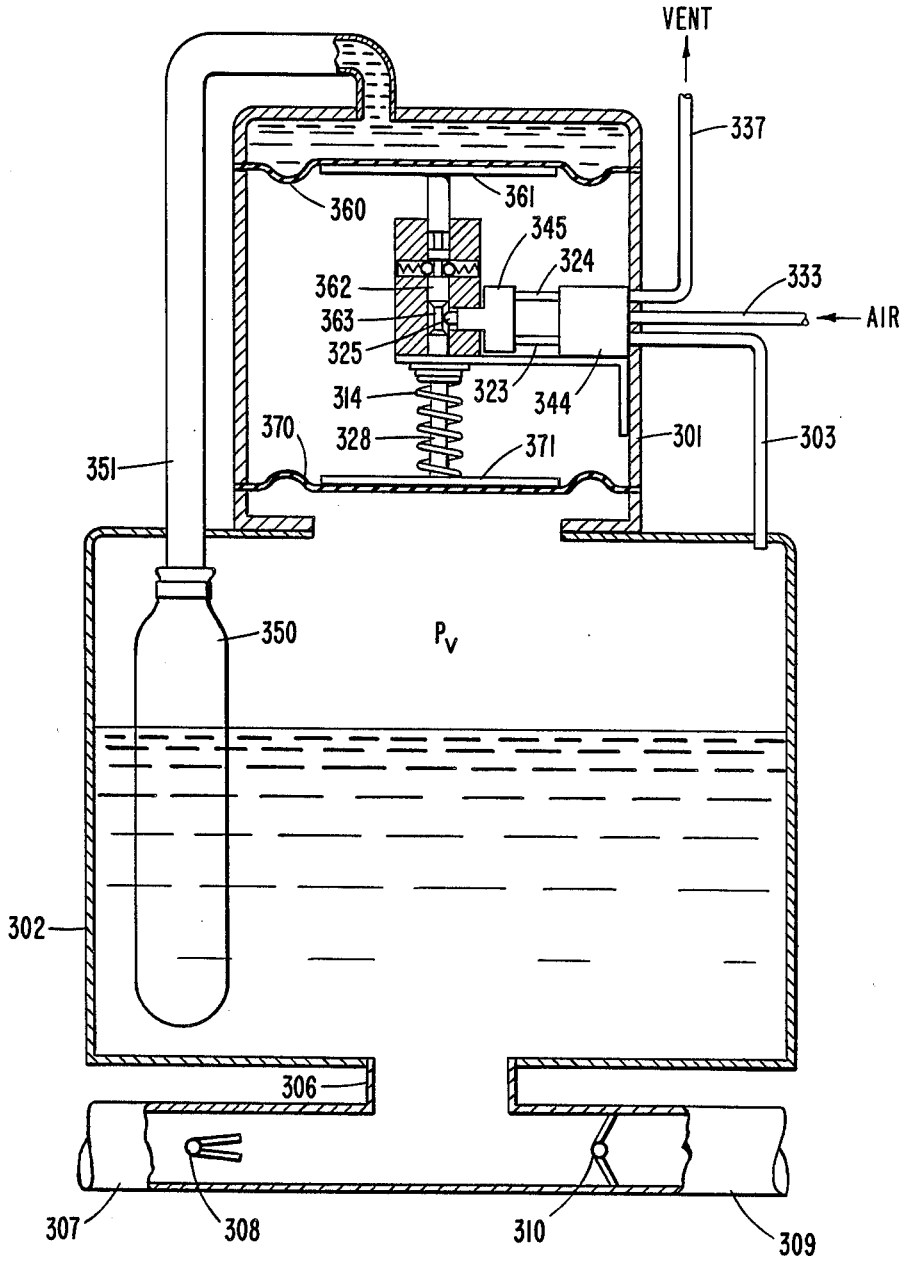
FIG. 3 illustrates a second embodiment of a pump system in accordance with my invention.

In the embodiment of FIG. 3, the controller 301 is mounted directly on top of the pump chamber 302; the diaphragm 111 is replaced by two spaced apart diaphragms 360 and 370; and the pressure in the lower portion of the pump chamber is conveyed to the controller by a liquid filled assembly which includes the compressible member 350 and the conduit 351. The control chamber between the diaphragm 360 and the diaphragm 370 may be filled with gas under pressure to reduce strain on the control assembly.

As in FIG. 1 and FIG. 2, the controller 301 of FIG. 3 responds to the difference in pressures in the upper and lower regions of the pump chamber to asynchronously cycle the pump through fill and discharge cycles. Since the pressure in the upper portion of the pump chamber is applied to both the bottom face of the lower diaphragm 370 and to the compressible tube 350, the difference in the pressures which are applied to the diaphragm 360 and the diaphragm 370 is due soleley to the height of the liquid in the chamber 302.

In FIG. 3, the controller assembly is shown in the pump fill mode. In that mode, liquid is free to flow into the pump chamber through the input port 307; and the output port 309 is blocked by operation of the valve 310. As the liquid flows into the chamber, the air or gas in the pump chamber is vented through a path which includes: conduit 303, a path through the main air valve 344 and the vent conduit 337. As the liquid rises in the pump chamber, the member 350 is compressed and the liquid therein tends to force the diaphragm assembly downward. When the sum of the force applied to the upper face of the diaphragm 360 and the force of the compressed coil spring 328 exceeds the sum of the force applied to the lower face of the diaphragm 370, the restraining force of the pilot valve ball 325 against the camming surface 362 and the restraining force of the detent assembly, the diaphragm assembly will snap downward to the discharge state. In that state, the ball 325 is moved into the body of the pilot valve 345 to connect air from the source conduit 333 to the control input conduit 329 of the main air valve 344. This activates the main air valve which blocks the path to the vent conduit 337 and connects the air source conduit 333 to the uppe portion of the pump chamber via the conduit 303. As the air enters the pump chamber, the valve 308 is closed, the valve 310 is opened and liquid is ejected through the output port 309.

As the liquid is ejected from the pump chamber 302, the pressure which is applied to the upper face of diaphragm 360 falls. When the pressure at the upper face of the diaphragm 360 reaches a second threshold value, the spring 328 is compressed; the control assembly is restored to the rest state; the pilot valve 345 and the main valve 344 are deactivated; and the fill mode is reactivated.

As compared to the physical placement of the bias spring 114 of FIGS. 1 and 2, the bias spring 314 of FIG. 3 is placed to have a bias effect opposite to that of spring 114. In FIGS. 1 and 2, the bias spring 114 urges the diaphragm 111 toward the "fill" or rest state. In FIG. 3, the bias spring is placed to bias the diaphragm assembly toward the discharge state. In FIG. 3, the liquid in the compressible chamber 3251 and the conduit 351 tends to draw the diaphragm 360 upward toward the "discharge" state. The function of the bias spring 314 is to overcome part of that upward force and to set the "operating" point of the diaphragm to initiate and terminate pumping when the depth of water in the pump reaches corresponding predetermined values.

The embodiments shown and described herein are only illustrative of the teaching of my invention and many changes in detail may be made without departing from the spirit and scope of my invention.

What is claimed is:

1. A gas driven pump system comprising:

a rigid elongated tubular body defining a pump chamber and comprising: top, bottom and side walls;

liquid inflow conduit means in communication with said chamber through said bottom wall; first liquid valve means for preventing flow of liquids out of said chamber through said inflow conduit means;

liquid outflow conduit means in communication with said chamber through said bottom wall; second liquid valve means for preventing flow of liquids into said chamber through said outflow conduit means;

main air conduit means in communication with said chamber through an opening in or near said top end of said body for conveying gases from and to said chamber for selectively venting and pressurizing said chamber;

control reference pressure conduit means in communication with said chamber; one end of said reference pressure conduit means extending outside said body and the other end thereof positioned in or near said top end of said body;

control high pressure conduit means in communication with said chamber; one end of said high pressure conduit means extending outside said body, and the other end thereof being positioned in said chamber near said bottom end of said body;

a source air conduit means for connection to a source of air or gas under pressure;

bubble source conduit means including a restriction therein coupling said source air conduit means to said high pressure conduit means for providing gas at essentially zero pressure to said high pressure conduit means;

switching means comprising: an air supply input port for connection to said source air conduit means; a vent port; a main air port connected to said main air conduit means; and means for selectively connecting said main air port to said vent port in one state of said switching means and for connecting said air supply port to said main air port in a second state of said switching means;

sensing means comprising: means coupled to said control reference conduit means for sensing the pressure within said chamber at or near the top end thereof; means coupled to said control high pressure conduit means for sensing the pressure within said chamber at or near the bottom end thereof; and means for controlling said switching means to switch from said one state to said second state and to restore said switching means to said first state as a function of the difference between the pressures sensed in said top and bottom ends of said chamber; and first and second purge air conduit means for respectively coupling said main air conduit means to said control reference conduit means and to said control high pressure conduit means; said purge air conduit means each comprising gas flow check valve means permitting air to flow from said main air conduit and preventing the flow of air in the opposite direction.

2. An ejector pump system in accordance with claim 1 wherein: said liquid inflow conduit means and said liquid outflow conduit means are in communication with said chamber through a common opening in said body.

3. A gas driven pump system in accordance with claim 1 wherein: said sensing means controls said switching means to switch from said one state to said second state when the difference in pressures in said reference and said high pressure conduits rises to a threshold value, and controls said switching means to switch back to said one state when the difference in pressures in said conduits subsequently falls below a second threshold value which is less than said first threshold value.

4. A control for a gas driven pump system in accordance with claim 1 wherein: said sensing means comprises a flexible diaphragm movable between a rest position and an operated position; one side of said diaphragm being in communication with said reference conduit and the other side of said diaphragm being in communication with said high pressure conduit.

5. A gas driven pump system in accordance with claim 1 wherein: said switching means comprises a mechanically operated pilot valve and an air operated main valve controlled by said pilot valve.

6. A gas driven pump system in accordance with claim 1 wherein:

said sensing means comprises a flexible diaphragm movable between a rest position and an operated position; one side of said diaphragm being in communication with said reference conduit means and the other side of said diaphragm being in communication with said high pressure conduit means, said switching means comprises a mechanically operated pilot valve assembly coupled to and operated by motion of said diaphragm and an air operated main valve controlled by said pilot valve.

7. A gas driven pump system in accordance with claim 6 wherein: said pilot valve assembly comprises a bias spring for applying a force which urges said diaphragm to said rest state in which said pilot valve is closed and said main valve is in the one state.

8. A gas driven pump system in accordance with claim 7 wherein:

said pilot valve assembly comprises a roller operated pilot valve comprising a T shaped body and a spring loaded roller ball protruding from one leg of said body; a spool block having a spool passage therethrough; a spool slidable in said spool passage and having one end affixed to said diaphragm; an operator passage in said spool block in communication with said spool passage for receiving said one leg of said pilot valve body; and said spool comprises a cam surface disposed adjacent said operator passage when said diaphragm is at the rest position and positioned opposite said operator passage and in operative engagement with said roller ball when said diaphragm is at the operated position.

9. An ejector pump system in accordance with claim 8 wherein: said pilot valve assembly further comprises: a spring loaded detent assembly mounted in said spool block and protruding into said spool passage; and said spool comprises at least one detent depression for engaging said detent assembly.

* * * * *